US008632320B2

(12) United States Patent
Palomba et al.

(10) Patent No.: US 8,632,320 B2
(45) Date of Patent: Jan. 21, 2014

(54) HIGH-PRESSURE COMPRESSION UNIT FOR PROCESS FLUIDS FOR INDUSTRIAL PLANT AND A RELATED METHOD OF OPERATION

(75) Inventors: Sergio Palomba, Florence (IT); Andrea Masi, Calenzano (IT); Marco De Iaco, Florence (IT); Massimo Camatti, Pistoia (IT); Lorenzo Bergamini, Bari (IT)

(73) Assignee: Nuovo Pignone S.p.A., Florence (IT)

( * ) Notice: Subject to any disclaimer, the term of this patent is extended or adjusted under 35 U.S.C. 154(b) by 205 days.

(21) Appl. No.: 12/830,486

(22) Filed: Jul. 6, 2010

(65) Prior Publication Data

US 2011/0008186 A1 Jan. 13, 2011

(30) Foreign Application Priority Data

Jul. 10, 2009 (IT) ..... MI2009A001235

(51) Int. Cl.
*F04B 35/06* (2006.01)

(52) U.S. Cl.
USPC ..... 417/247; 417/243; 417/372; 417/423.14

(58) Field of Classification Search
USPC ..... 417/247, 372, 423.14, 243
See application file for complete search history.

(56) References Cited

U.S. PATENT DOCUMENTS

| | | | | |
|---|---|---|---|---|
| 4,969,803 | A | 11/1990 | Turanskyj | |
| 6,196,809 | B1 | 3/2001 | Takahashi et al. | |
| 6,390,789 | B1 * | 5/2002 | Grob et al. | 417/350 |
| 6,464,469 | B1 | 10/2002 | Grob et al. | |
| 6,856,053 | B2 | 2/2005 | LeFlem et al. | |
| 7,923,871 | B2 | 4/2011 | Weiss | |
| 2003/0059299 | A1 | 3/2003 | Miura et al. | |
| 2007/0018516 | A1 | 1/2007 | Pal et al. | |

FOREIGN PATENT DOCUMENTS

| | | | |
|---|---|---|---|
| DE | 1813335 | A1 | 12/1967 |
| DE | 3729486 | C1 | 12/1988 |
| EP | 1069313 | B1 | 3/2000 |
| EP | 1074746 | B1 | 3/2000 |
| EP | 1251624 | B1 | 4/2002 |
| EP | 1392981 | B1 | 5/2002 |
| EP | 1482179 | B1 | 7/2004 |
| EP | 2113671 | A1 | 6/2008 |
| WO | 9524563 | A1 | 9/1995 |
| WO | 2009115389 | A1 | 9/2009 |
| WO | 2010018171 | A1 | 2/2010 |
| WO | 2011014934 | A1 | 2/2011 |

OTHER PUBLICATIONS

European Search Report and written opinion issued in connection with corresponding application No. EP10168793 on Feb. 8, 2011.
Third Party Observations dated Sep. 27, 2011 from corresponding EP Patent Application No. 10168793.7.

* cited by examiner

*Primary Examiner* — Charles Freay
*Assistant Examiner* — Patrick Hamo
(74) *Attorney, Agent, or Firm* — Global Patent Operation

(57) ABSTRACT

An integrated high-pressure compression unit for a process fluid that includes at least a first compression device able to compress the process fluid from a essentially gaseous initial thermodynamic state to an intermediate thermodynamic state, a second compression device connected mechanically to the first compression device and able to compress the process fluid from the intermediate thermodynamic state to a final thermodynamic state, a motor device able to drive the first compression device and the second compression device, and a pressure casing or housing in which at least the said first and second compression devices are mechanically coupled to each other.

17 Claims, 6 Drawing Sheets

HIGH-PRESSURE COMPRESSION UNIT FOR PROCESS FLUIDS FOR INDUSTRIAL PLANT AND A RELATED METHOD OF OPERATION

CROSS-REFERENCE TO RELATED APPLICATIONS

This application claims priority under 35 U.S.C. §119(a)-(d) or (f) to prior-filed, co-pending Italian patent application number MI2009A001235, filed on Jul. 10, 2009, which is hereby incorporated by reference in its entirety.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO A SEQUENCE LISTING, A TABLE, OR COMPUTER PROGRAM LISTING APPENDIX SUBMITTED ON COMPACT DISC

Not applicable.

BACKGROUND OF THE INVENTION

1. Field of the Invention

The present invention refers to a high-pressure compression unit, preferably but not exclusively for use in re-injection plant for gases, whether acid or not, and a related method for compressing a process fluid.

2. Description of Related Art

A compressor is a machine capable of increasing the pressure of a compressible fluid (gas) through the use of mechanical energy. The various types of compressor used in process plant in the industrial field include so-called centrifugal compressors, in which energy is supplied to the gas in the form of centrifugal acceleration due to rotation, generally controlled by a driver (electric motor or steam turbine), through a component called a rotor or impeller.

Centrifugal compressors may be fitted with a single rotor, in the so-called single stage configuration, or may have a number of impellers arranged in series, also known as multi-stage compressors. More precisely, each of the stages of centrifugal compressor is normally composed of an intake duct for the gas to be compressed, an impeller, which is able to supply kinetic energy to the gas, and a diffuser, the role of which is to convert the kinetic energy of the gas coming out from the impeller into pressure energy.

Gas injection is normally the reintroduction of natural or inert gas into subterranean deposits of hydrocarbons, typically containing both gases and liquid crude oil, so as to increase the pressure within the deposit itself, improving the extraction capacity for crude oil, and therefore the yield of the well. In addition, the re-injection of gas, particularly acid gas, into the deposit, can contribute to a reduction in the environmental impact that would otherwise occur if it were necessary to dispose of the residues from treating the gas.

Hydrocarbons are organic compounds which contain atoms of carbon and hydrogen.

In short, in hydrocarbons, the carbon atoms (C) are linked to one another to form the core of the molecule, while the hydrogen atoms (H) extend from this core. Up to the present time, more than 130 thousand types of hydrocarbons have been classified. The most simple hydrocarbon is methane, having a formula CH4. Increasing the number of carbon atoms, gives ethane, with a formula C2H6, ethene (or ethylene), C2H4 and acetylene, C2H2. In particular, crude oil is composed of a mixture of various hydrocarbons, alkanes, but with differences in appearance, composition and physical/chemical properties. Hydrocarbons are present in nature in various forms and in mixtures with other gases, which are of little interest and which are difficult to dispose of.

In compression plants that carry out the re-injection of gas, which are becoming increasingly widespread in the oil and hydrocarbons industry, it is necessary to have compression units available that are capable of operating at high pressures, which at present are quantifiable from 100 bar to approximately 300 bar. Moreover, it is predicted that future applications will require compression units with higher performance, in order to compress the gas to pressures in excess of 500 bar.

In order to compress the fluid, without condensates, it is possible to compress it by limiting or eliminating inter-refrigeration, with a consequent reduction in the efficiency of the compression process itself.

Likewise, it is possible, once the critical state of the fluid has been reached by means of compression, to condense it through cooling and to continue the compression by means of a pump positioned externally with respect to the compression unit itself.

One disadvantage of the traditional high-pressure compression units is the fact that they are technically difficult to design because of the various problems of a mechanical or fluid-dynamic nature that are encountered on increasing the maximum output pressure. Examples of such technical difficulties are: the complications of the systems of external sealing, the fluid dynamic performance and others.

Another disadvantage is that the compression units are increasingly required to operate at pressures well above the critical pressure of the process fluid, causing a worsening of the above-mentioned technical problems. In addition, the compression of a super-critical fluid at high temperature reduces the efficiency of the compressor.

A further disadvantage is that in the event that a normal pump is used externally to the compression unit, even though such use may contribute to a significant increase in the cost of the plant, there is a high risk that losses of gas into the atmosphere will arise, which is particularly critical if acid gases are present.

In fact, the use of a pump mechanically connected to the compression unit by means of a shaft passing to the outside, although in some cases this may reduce the mechanical complexity of the machine (it is possible to use a single motor to drive the compressor and the pump), it does bring a significant risk of gas losses from the external dynamic seals that must be fitted on the shaft connecting the unit and the pump.

These external dynamic seals are therefore particularly critical in the presence of acid fluids, which increases the cost of design and maintenance of the unit in order to guarantee the necessary safety.

A further disadvantage is the fact that traditional machines are bulky and heavy and therefore relatively expensive to transport and install, particularly in marine or submarine applications where weight is important, such as for example in platforms, "Floating Storage and Offloading units" (units operating at anchor in the open sea for the storage of oil after extraction from a marine field), submarine wells and other cases.

Therefore at present, in spite of the developments in technology, problems remain and a need is recognized for the production of a high-pressure compression unit for fluids, particularly but not only acid or dangerous gases, which has a higher performance, is economically sustainable both in its construction and in maintenance, and which at the same time guarantees a reduction of risk of losses to the external environment.

BRIEF SUMMARY OF THE INVENTION

The general aim of the present invention is to produce a high-pressure compression unit for use in industrial plant, which is able to overcome, at least partially, the above-mentioned problems present in the known technology.

In particular, it is an aim of the present invention to produce a high-pressure compression unit capable of operating in an efficient manner, even at pressures well above 100 bar.

Another aim of the invention is to produce a high-pressure compression unit which is capable of eliminating, or at least of reducing, the possible escape of gas into the atmosphere, which is particularly harmful to the environment in the case of acid gases.

In accordance with the present invention, these aims are achieved by producing a high-pressure compression unit for industrial plant, as explained in claim 1, and with a compression method, as in claim 15.

Advantageous aspects of the present invention are explained in the subordinate claims.

The object of the invention takes the form of an integrated high-pressure compression unit for a process fluid, comprising at least the following devices: A first compression device, able to compress the process fluid from a substantially gaseous initial thermodynamic state on inlet to an intermediate thermodynamic state; a second compression device connected mechanically to the first compression device, and able to compress the process fluid from said intermediate thermodynamic state to a final thermodynamic state and a single casing or envelope under pressure (also called "pressure casing" or "pressure boundary") in which are located at least the first and second compression devices, mechanically coupled to each other.

In one particularly advantageous embodiment of the invention, the driving device is also located inside the casing, directly coupled to the first and second compression device, so as to produce a particularly compact compression unit.

A "first compression device" advantageously and preferably means a device suitable for compressing the gas on inlet to an intermediate thermodynamic state, such as for example by means of a multistage centrifugal compressor or other device.

A "second compression device" is advantageously and preferably means, such a device capable of compressing the fluid on inlet from the intermediate state to the final thermodynamic state. In particular, the fluid in the intermediate thermodynamic state may be in a liquid or super-critical state; in the first case (the liquid state) the second device can be a compressor or multistage centrifugal pump, or other device, see descriptions below.

As an advantage, the process fluid on inlet may be a mixture of different gases that may contain liquid or solid impurities, such as for example mixtures of acid gases (in re-injection plant for oil wells), hydrocarbons (in petrochemical plant), natural gas (in gasification plant) or mixtures containing carbon dioxide (CO2) or others.

In the preferred embodiment of the invention, the compression unit is manufactured in such a manner that the above-mentioned pressure casing includes mechanical seals of the static type only on its external side; in other words, the above-mentioned casing includes "external static seals" or "gaskets operating on the outside" without "external dynamic seals", that is to say, avoiding the provision of rotors which extend from the inside of the casing to the outside.

However, in this case the pressure casing is preferably manufactured by means of one or more shells with sealed connections between them by means of the above-mentioned "static external seals" and possibly enclosed by one or more additional external casings, depending on the particular design or installation requirements.

"Dynamic seals" is any type of mechanical seal which serves to isolate two environments between which is situated a rotating member, and which acts upon the member itself in such a manner as to prevent at least partially the leakage of liquids or gas.

An "external dynamic seal" is a seal which faces towards the outside of a machine (environment side) suitable for preventing leaks of process fluids towards the outside with from rotating parts that project into the external environment.

An "internal dynamic seal" is a seal positioned inside a machine (on the process side) that serves to prevent leaks within the compartments of the machine itself.

A "static seal" means any type of mechanical seal between two fixed surfaces capable of isolating two environments in order to avoid leaks of gas or fluid.

A static seal may also be classified as an "external static seal", which faces towards the outside (environment side) or "internal static seal", which is positioned inside a machine (on the process side).

Such seals, whether static or dynamic may in any case be formed of a series of components and of numerous types of material—as is well known to engineers in the field—for example, using elastomers, metals or other materials.

The pressure casing (formed of one or more shells with sealed connections between them) has at least one inlet aperture, one outlet aperture and possibly lateral service apertures which are in communication with the fluid, with an internal flow path for the process fluid; additional apertures in the casing are provided for the electronic/electrical management and control systems.

It should be noted that the pressure casing may be manufactured from a single shell, and in this case a radial or axial inlet section may be provided (closed by a cover with an external static seal) which may be necessary for introducing devices into the inside of the shell.

The second compression device, in accordance with the invention, is preferably able to work at the same rotational speed as the first device, without speed reducers, in order to avoid the necessity for lubricating circuits for the gears, which will additionally simplify the construction and maintenance of the unit.

However, it should not be ruled out that provision could be made for a gearbox or speed converter between the first and the second compression devices, so as to regulate the rotational speed of the second device independently with respect to the first.

Advantageous embodiments of the invention provide that the first and second compression devices are driven by a drive shaft by means of the same rotor, achieving an additional size reduction for the machine, or by means of a number of rotors coupled axially by means of appropriate mechanical joints.

In this last case, these mechanical joints may be of a flexible or rigid type, such as for example a direct coupling or with frontal gear teeth, or magnetic couplings or other type.

Along the process path between the first and the second compression device, provision may be made for at least one device for external cooling of the fluid, in order to increase the output of the machine as a whole. Moreover, it is possible to provide for additional external cooling devices between at least some of the intermediate stages of the first and/or second compression device, in order to further increase the performance of the machine.

In one particularly advantageous embodiment, provision is made for at least one passage aperture for the drive shaft, situated between the second compression device and one of the other devices in the unit.

This passage aperture can have any form or dimension depending on the particular application, such as for example, having a constant or variable section, a substantially cylindrical form approximately coaxial with respect to the rotor, or in other forms.

In one particularly advantageous method of driving, this passage aperture is situated between the second compression device and the high-pressure side of the first compression device, in order to minimize the loads on the sealing systems between the two devices, while at the same time reducing the mechanical complexity of the unit.

In another advantageous method of driving, at least one first internal dynamic seal acting on the rotor on the drive shaft is installed inside this aperture in order to at least partially impede the passage of the process fluid from one device to the other.

Preferred embodiments of the invention provide that the first internal seal does not give a high degree of fluid-dynamic isolation between the devices that fitted on opposing sides of the passage aperture.

In accordance with further embodiments of the invention, it is also possible to provide for some controlled loss or leakage from the first internal dynamic seal, which is useful for the operation of the unit itself, or, alternatively, to eliminate it, see descriptions below.

However, the first internal dynamic seal—when it is fitted—is particularly simple and economic in design, installation and maintenance, since it does not need to guarantee a high degree of isolation.

In accordance with another advantageous embodiment of the invention, at least one of the possible mechanical joints for the rotor on the drive shaft is situated in the passage aperture, in order to minimize laminar flow losses.

In accordance with another advantageous embodiment of the invention, at least one first mechanical support bearing for a rotor on the drive shaft is provided for within the passage aperture, so as to optimize the rotor dynamics, the static and dynamic load distribution and the forces transmitted to the machine supports, in particular depending on the length of the drive shaft and the weight and dimensions of the rotors.

This first bearing may be of a traditional type, for example magnetic, or hydrostatically supported or of another type.

It should not be ruled out that the installation of the first bearing inside the aperture could be avoided if it is not necessary for supporting the rotor or for mechanical balancing or for the rotor dynamics of the unit, for example in configurations in which the axial length of the rotor is sufficiently short, see descriptions below.

Finally, one or more of the above-mentioned components (the first seal, the first bearing, or the joint), or a combination of the same, may be situated in the passage aperture.

Further mechanical support bearings are provided for in different quantities and positions on the rotor on the drive shaft in accordance with the particular design requirements.

All the above-mentioned mechanical bearings may be of an essentially traditional type, preferably of a type that does not require lubrication, such as for example, bearings of a magnetic type, or with hydrostatic support or others.

In one particularly advantageous embodiment, at least one cooling system is provided, which is able to cool the said mechanical bearing by means of the process fluid so as to simplify the mechanical complexity of the plant and considerably reduce the costs for installation and maintenance in return for a small loss in performance due to the quantity of fluid used for such cooling.

In particular, the unit, in accordance with the present invention, may include a protection system for critical mechanical components (for example, the electrical components such as the motor windings and possible magnetic bearings) produced by means of known types of protective barrier, in case the process fluid contains corrosive or erosive agents capable of damaging these items in a very short time.

It is not to be ruled out entirely that it may be possible to use a cooling fluid other than the process fluid; in this case an appropriate cooling circuit must be provided, which would considerably increase the complexity and cost of the unit.

The above cooling system may be produced with at least one fluid dynamic cooling circuit of a closed type, that is to say, able to return the process fluid into circulation within the unit after the cooling of the above-mentioned one or more mechanical support bearings.

In particular, the possible positioning of the first bearing in the passage aperture, although offering the above-mentioned advantages, may present difficulties with respect to its cooling as a result of the particular configuration of the unit, particularly if this bearing is fed at least partially by the process fluid at a high temperature, which is above the cooling temperature.

In order to try to overcome such difficulties, while at the same time optimizing the cooling and reducing the mechanical complexity for the unit, a study has been made for a first fluid dynamic cooling circuit for this first bearing depending on the various configurations and operating requirements, such as for example, conditions of the flow of the process fluid within the passage aperture as a result of the seal which might possibly be fitted there, or in other circumstances.

In the preferred embodiment of the invention, the first compression device is a centrifugal compressor with one or more stages, each formed with a centrifugal impeller and with related channels in the stators, the drive device is an electric motor, and the second compression device is a pump or centrifugal compressor for liquids or super fluids having one or more stages, which are also each formed of one centrifugal impeller and related channels in the stator.

In particular, the centrifugal impellers of the first and second compression devices are preferably combined on the same rotor on the drive shaft, so as to achieve a particularly compact compression unit.

The term "super-critical fluid" means a fluid which is at a temperature higher than the "critical temperature" and at a pressure higher than the "critical pressure". In such conditions, the properties of the fluid are partially analogous to those of a liquid (for example, the density) and partially similar to those of a gas (for example, the viscosity), see descriptions below in reference to FIG. 1B. In accordance with another aspect, the present invention concerns a method for the compression of a process fluid comprising at least the following phases:

to provide a single pressure casing or pressurized envelope closed by means of "static external seals", that is to say, without "dynamic external seals"; to provide inside the said single pressure casing or pressurized vessel, at least one first compression device able to compress a fluid on inlet from one substantially gaseous thermodynamic state to an intermediate thermodynamic state; at least one second compression device connected mechanically to the first compression device and able to compress the process fluid from the intermediate thermodynamic state to a final thermodynamic state, and at least one motor device able to drive the above-mentioned first and second devices through the same drive shaft; to activate the motor device so as to compress the process fluid to the final thermodynamic state or to the delivery state.

In one particularly advantageous method of drive, the activation phase provides for activating the first compression device for compressing the process fluid to the intermediate thermodynamic state at a super-critical level, and activating the second compression device in order to further compress this super-critical fluid from the super-critical thermodynamic state to the thermodynamic state for final delivery.

It cannot be entirely ruled out that the fluid in the intermediate thermodynamic state may be in a liquid phase depending on a particular application.

Subsequent intermediate phases may can be provided to cool the process fluid during the compression carried out by means of the first and/or second compression device.

The above-mentioned activation phase may also provide at least one of the following initial sub-phases:
to activate an external feed circuit for refilling at least partially the second compression device with a process fluid in thermodynamic conditions similar to that which is fed by the first compression device; and then to activate the first compression device and, at the same time, the second compression device through the same drive shaft; or to activate the second compression device with a delay with respect to the first compression device in such a manner as to fill, at least partially, the second compression device before it is activated; or to activate the first and second compression devices simultaneously through the same drive shaft; in this case the second device rotates in idling mode until the fluid arrives to fill it.

One advantage of a compression unit in accordance with the present invention is the fact that it is able to operate in an efficient and effective manner at high pressures, overcoming at least partially the problems with known compression units.

In particular, in accordance with one preferable embodiment, such a unit is able to compress a process fluid up to pressures well above its critical pressure with a high output, since the compression of the fluid in a super-critical state is carried out to a large extent by means of a centrifugal pump, which suffers a reduction in efficiency which is less than that suffered by the centrifugal compressor.

Another advantage is the fact that there is an enormous reduction in the risk that losses of gas to the atmosphere may occur (particularly critical in the case of acid gases) since the systems of sealing towards the external environment are particularly effective and efficient; at the same time there is also a reduction in the requirement for periodic maintenance and inspection of the said sealing systems towards the external environment, and therefore the costs both of design and maintenance are reduced.

A further advantage is that such units are extremely versatile, since it is possible to provide many configurations depending on the plant, environmental conditions or types of working fluid, such as for example, plant in the desert, submarine plant, plant for re-injection of gas for oil wells or others. In particular, the possible configurations may be achieved through a different relative positioning of the compression devices and/or the motor, through a different number or positioning of the mechanical bearings (for example, providing at least one first support bearing in the passage aperture) or in other ways.

However, another advantage is that it is possible to carry out dynamic rotary balancing of the unit in accordance with the invention, which for this kind of machine is a particularly critical aspect, as a result of the particular demands of their use, such as for example, on the basis of the maximum power, the conditions of the fluid on inlet and/or delivery, the number of revolutions etc.

A further advantage is that it is possible to compress a mixture of different fluids, such as for example, a mixture of acid and/or dirty gases, obtaining a high compression performance and minimizing the possible disadvantages.

One advantage of one particular embodiment, in the case of a compression unit in accordance with the invention being used in a plant for re-injecting acid gas into a hydrocarbon well, can be seen in the fact that it is possible to increase the output of the well (that is to say, increase the quantity of hydrocarbons extracted) when compared with re-injection with traditional compression units, since it is possible to re-inject the gas at the super-critical stage at very high pressures, and in a manner that is extremely safe.

Finally, the compression unit in accordance with the present invention has a particularly high performance and is particularly versatile, while at the same time being safer for the environment and the users.

Further advantageous characteristics and embodiments of the method and the device in accordance with the invention are indicated in the attached claims, and will be further described below, with reference to some non-exhaustive examples of embodiment.

BRIEF DESCRIPTION OF THE DRAWINGS

The present invention can be better understood, and its many aims and advantages can become evident to experts in the field, by referring to the schematic drawings attached, which show practical, but not exhaustive, examples for the invention. In the drawings.

DETAILED DESCRIPTION OF THE INVENTION

Figure 1:
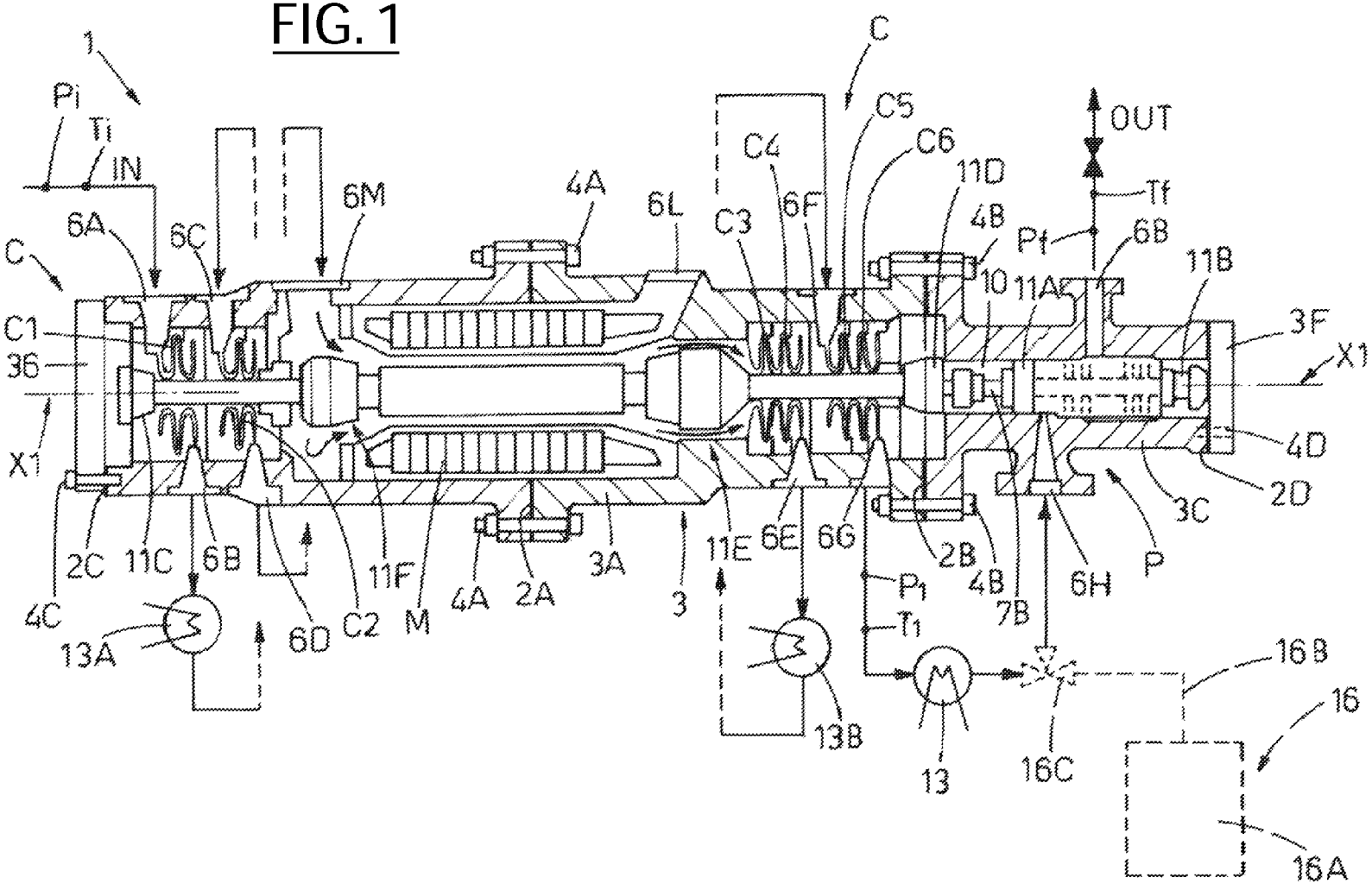
FIG. 1 is a schematic view in longitudinal section of one embodiment of a high-pressure compression unit produced in accordance with the present invention.

In the drawings, in which the same numbers represent the same parts in all the different diagrams, a high-pressure compression unit is shown in accordance with one embodiment of the invention indicated as 1 and includes a single pressure casing or envelope 3, inside which are located at least the following:

a first compression device C able to compress a process fluid F from one substantially gaseous thermodynamic state on inlet (at an inlet pressure Pi and outlet temperature Ti, depending on the type of fluid and the particular application) to an intermediate thermodynamic state (at an intermediate pressure P1 and at an intermediate temperature T1); a second compression device P able to compress the fluid F from the intermediate thermodynamic state (except for possible losses) up to a final thermodynamic state (at an outlet pressure of Pf and at an outlet temperature Tf) and mechanically coupled to the first device C along the same drive shaft X1; and an electric motor device M coupled mechanically along the drive shaft X1 to drive the compression devices C and P.

In particular, the inlet pressure Pi may be essentially low (approximately 1 bar) or essentially high (above 100 bar); and correspondingly the outlet pressure Pf may be above 100 bar, or rather up to approximately 500 bar or more. The temperatures Ti and Tf may vary correspondingly in accordance with the phase equations for the specific fluid used, depending on the relevant application or process.

In the embodiment shown here, the first compression device C is a centrifugal compressor, having six stages C1 to C6 (each comprising a centrifugal impeller and a stator groove system) and a motor device M, which is an electric motor of the sealed type which is interposed between the second stage C2 and the third stage C3 of the compressor C.

Similar configurations for a compression unit are described for example in patent applications US-2007-196215 from the same owner and US-2008-275865 in the name of General Electric.

It is clear that the number of stages and their positioning with respect to the motor M may vary depending on the particular construction or requirements for use, see below.

The pressure casing 3 is produced using a number of shells 3A, 3B, 3C, 3E and 3F, closed by sealed from each other by external static seals 2A to 2D and a number of bolts 4A to 4D, partially shown in FIG. 1.

It is clear that the fastening system using bolts 4A-4D is indicated here by way of example, and any other known type [of fastening system] can be used; moreover, the number and arrangement of bolts 4A-4D and of seals 2A-2D depends on the number of shells 3A-3F and on their shape, which may vary depending on the particular construction requirements.

Moreover, it is possible to provide a further external container casing, not shown in the diagram for simplicity.

Casing 3 has an inlet aperture 6A and an outlet aperture 6B for the fluid F in shell 3A and 3C respectively, and lateral service apertures 6C, 6F, 6G, 6H and 6M for the fluid F, see description below. A further aperture 6L is provided for the electrical/electronic connections—not shown in FIG. 1 for simplicity—that are necessary for the operation and control of the said unit 1.

Figure 2:
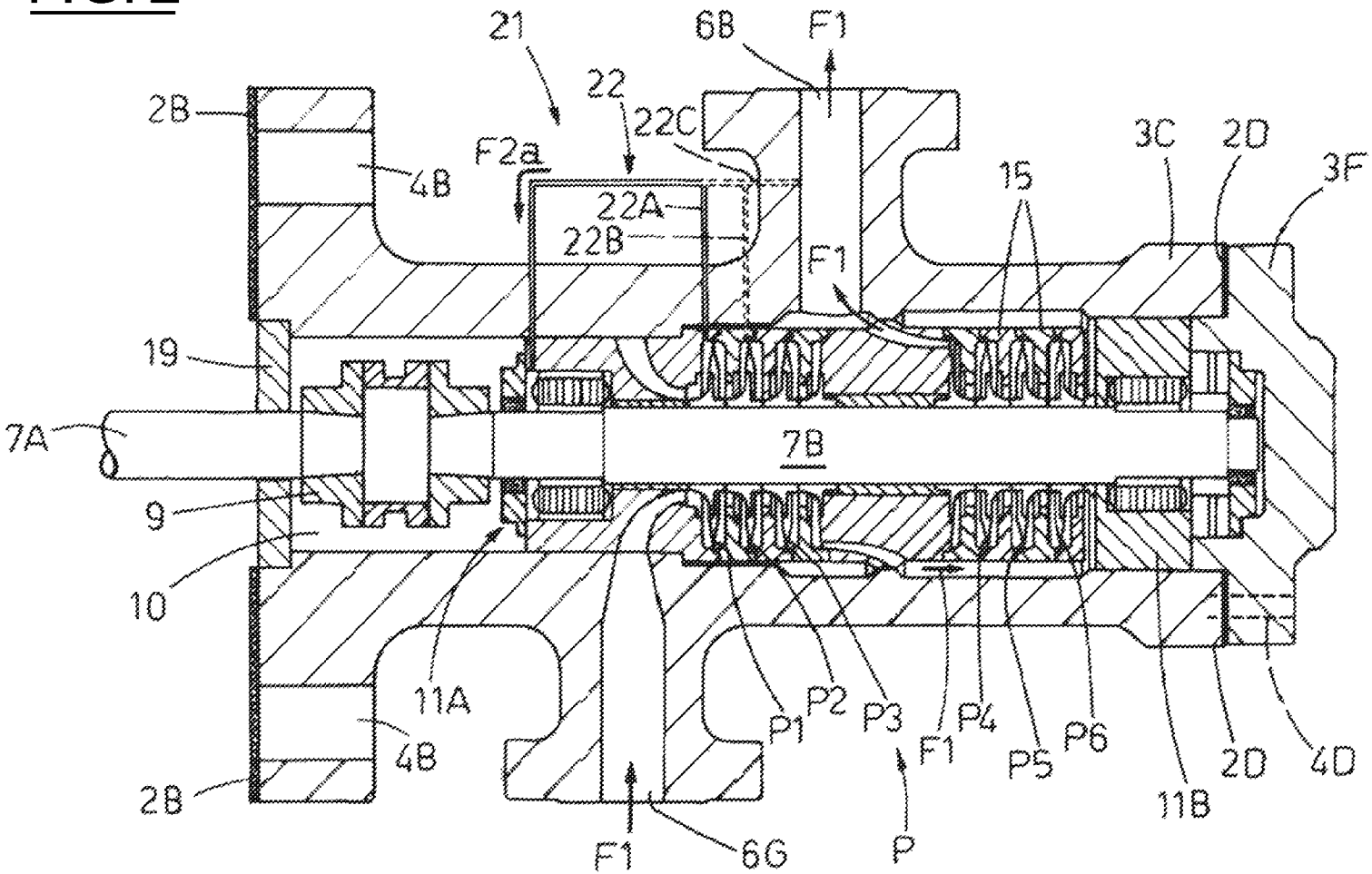
FIG. 2 is a schematic view in longitudinal section of a component of the high-pressure compression unit in accordance with one embodiment of the invention.
Figure 3:
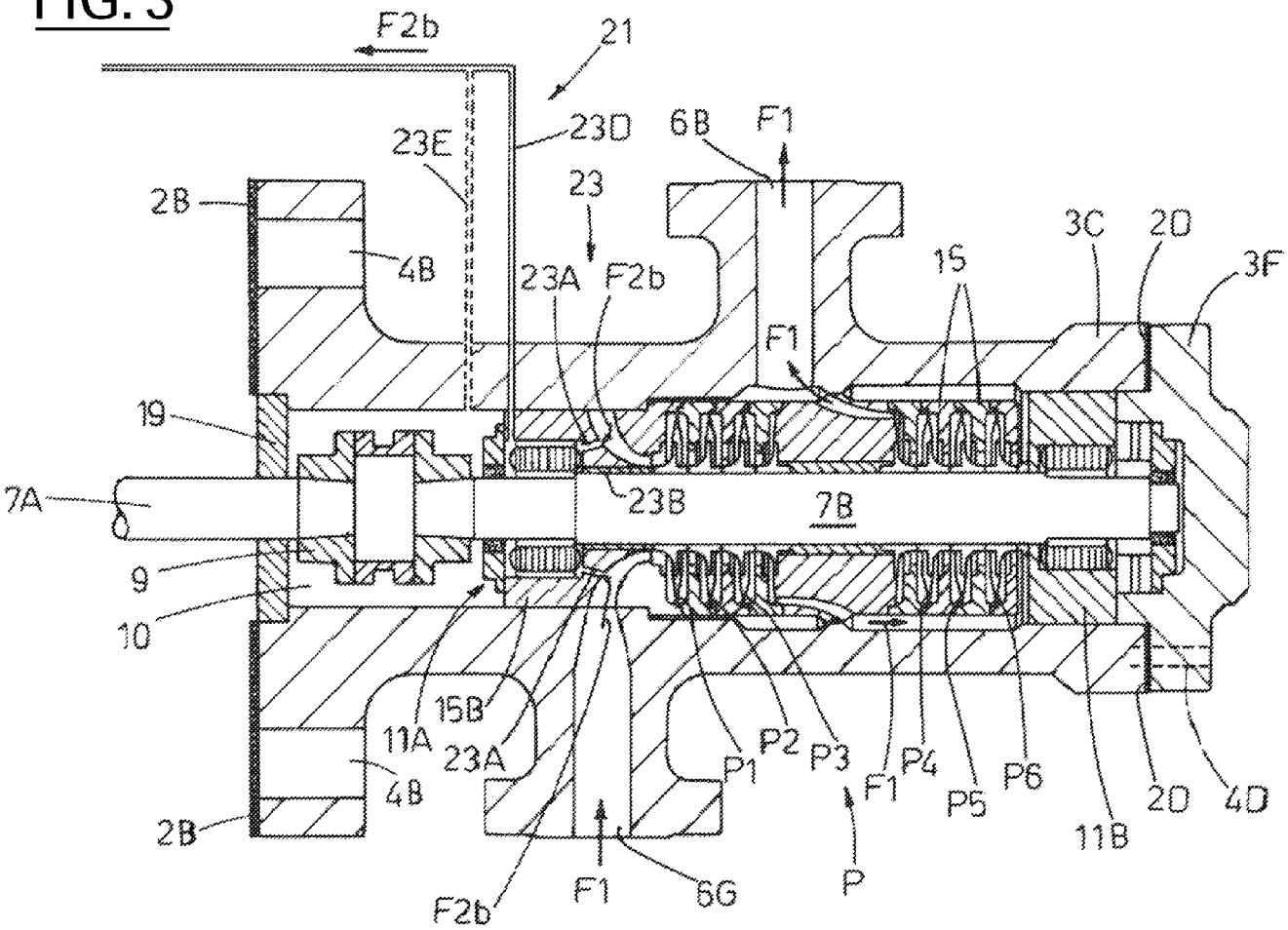
FIG. 3 is a schematic view in longitudinal section of a component of the high-pressure compression unit in accordance with another embodiment of the invention.
Figure 4:
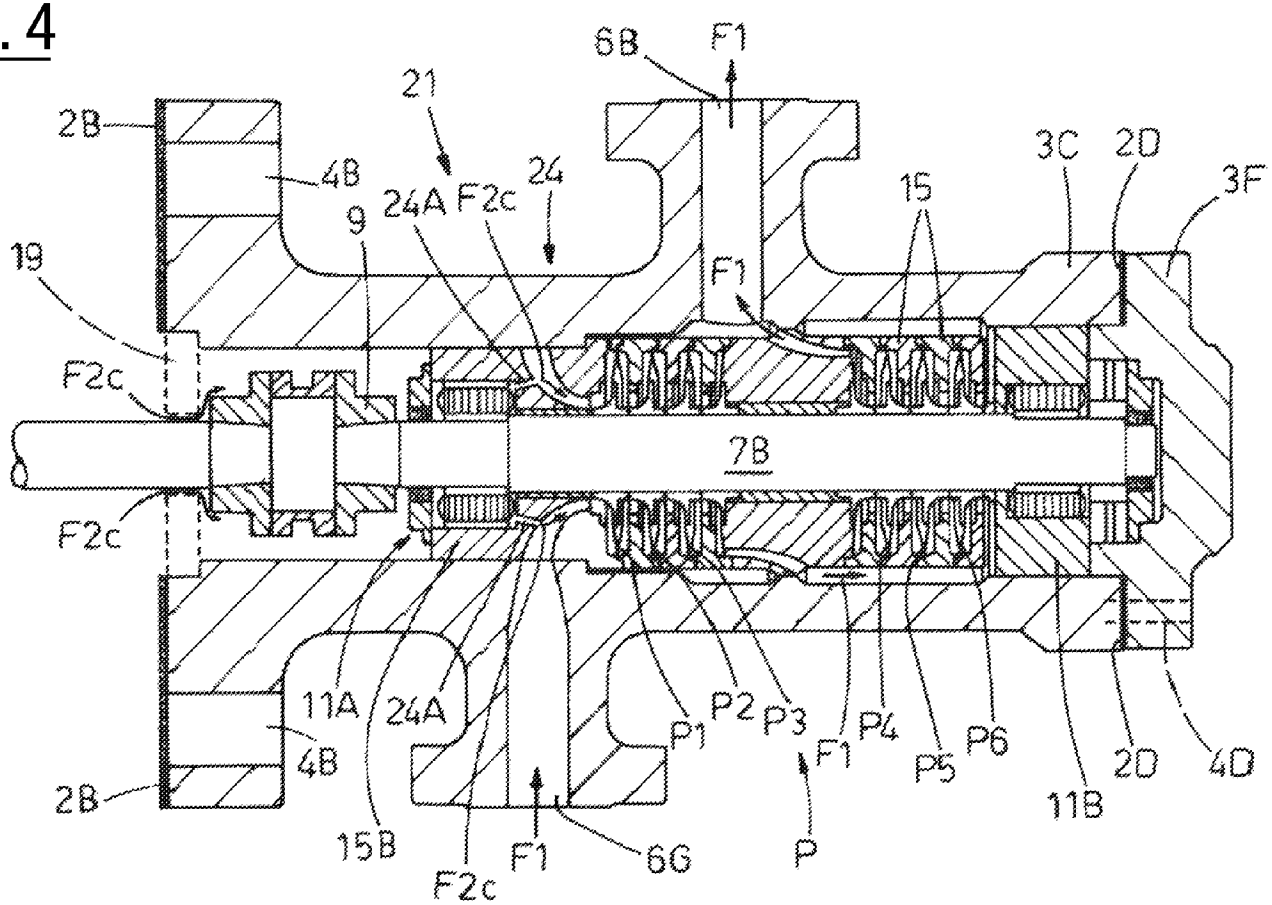
FIG. 4 is a schematic view in longitudinal section of a component of the high-pressure compression unit in accordance with a further embodiment of the invention.

The second compression device P shown here is a 6-stage centrifugal pump, see also the descriptions referred to in FIG. 2, FIG. 3 and FIG. 4, arranged downstream on the high pressure side of the compressor C.

As an advantage, the intake side of the pump P is placed side by side with the delivery side (high pressure stage) of the compressor C inside casing 3 in order to minimize the loads on the sealing systems between the two devices, while at the same time reducing the mechanical complexity of the unit.

The drive shaft X1 is produced—in the configuration described—by means of a first rotor 7A associated with the compression unit C and the motor M, and a second rotor 7B associated with pump P; rotors 7A and 7B are coupled axially by means of a mechanical coupling 9, see also FIG. 2; therefore the motor M drives directly either compressor C or pump P.

It is clear that the drive shaft X1 may be produced with a different number of rotors, for example, one single rotor or more than two, depending principally on their length.

In FIG. 1 it should also be noted that there is a passage aperture 10—see also descriptions in reference to FIG. 2, FIG. 3 and FIG. 4—between compressor C and pump P in which is provided coupling 9 and a first support bearing 11A.

The aperture 10 is presented in a form which is approximately cylindrical and coaxial with the rotor 7B, although it cannot be entirely ruled out that the aperture 10 may be produced with a different form and dimensions depending on the particular application.

In addition, provision is made for a second support bearing 11B to support the end of the drive shaft X1 at the end towards pump P1, a third and a fourth support bearing, 11C and respectively 11D, fitted at opposite ends in relation to compressor C and a fifth and sixth support bearing, 11E and 11F respectively, fitted at opposite ends with respect to the motor M.

As an advantage, the fourth bearing 11D is of the axial type and is able to withstand the axial loads, at least in part, thanks to a balancing system—not shown in the diagram for simplicity—which makes provision for pressurizing the side of the bearing facing compressor C, as for example is described in the patent applications referred to above.

It should be noted that in the configuration of the unit 1 described here, the support bearings 11A-11F are provided in such a manner as to facilitate the longitudinal and radial balancing of the machine; it is therefore possible to provide for different configurations of the unit in which the bearings are different in number and/or position depending on the particular application.

In addition, provision is made for a cooling system 21 of the closed type for cooling mechanical bearings 11A-11F using the process fluid.

In particular, the system 9 may comprise at least one fluid dynamic cooling circuit—not shown in FIG. 1 for simplicity—able to provide a fluid link from one of the last stages C5 or C6 of the compressor C to the bearings 11B to 11D so as to cool them using the process fluid itself.

In addition, provision is made for a first external cooling device 13 for the fluid F with a fluid link to the inlet of the delivery aperture 6G of the compressor C and to the outlet of the intake aperture 6H of pump P, so as to cool the process fluid leaving the compressor C before entering pump P.

In addition, provision can be made for further cooling devices, schematically indicated as 13A and 13B, which are in fluid connection with some of the stages C1-C2 and C4-C5 of the compressor C by means of the lateral service apertures at the inlet and outlet 6C, 6E and 6D, 6F respectively so as to carry out successive cooling so as to increase the degree of compression of the fluid.

It should be noted that each lateral service aperture 6A-6F, when provided, has a provision for a coupling flange with external static seals, not shown in the diagram for simplicity.

Figure 1B:
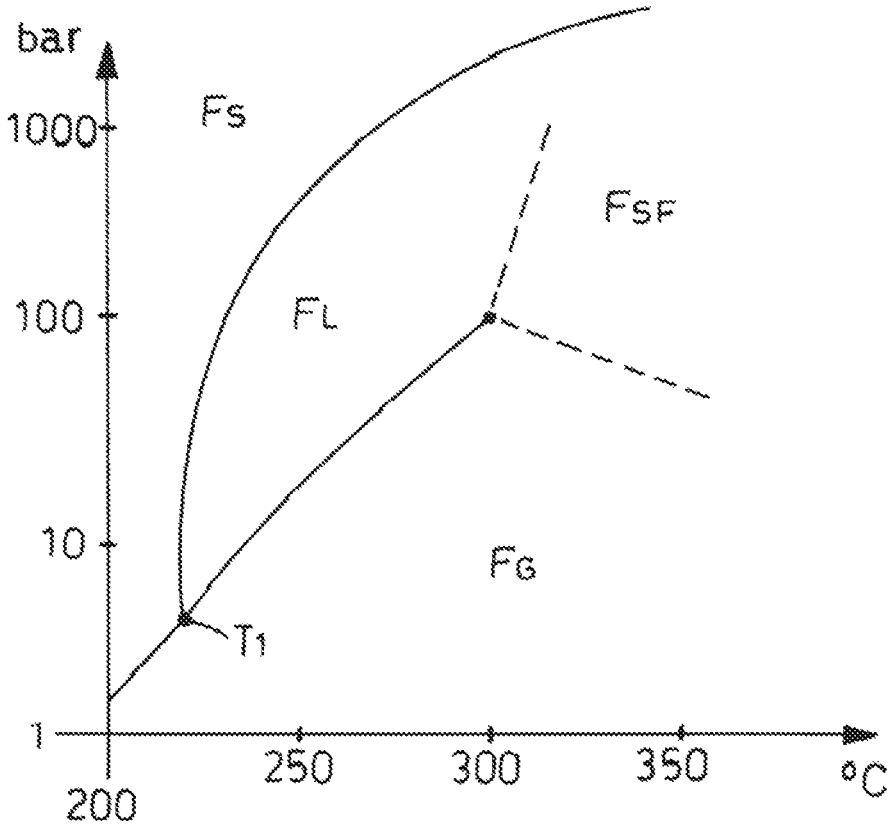
FIG. 1B is a schematic graph showing the phase diagram for carbon dioxide CO2.

In one advantageous embodiment of the invention, provision is also made for an external feed circuit 16, indicated in dotted lines in FIG. 1, comprising a tank 16A with a fluid link between the pump P and a possible first cooler 13 by means of a connecting pipe 16B and a 3-way valve 16C so as to at least partially fill the pump P with a fluid under the same conditions as that, which is being fed by the compressor C during the start-up of machine 1, see also description above. In FIG. 1B is shown a phase diagram for carbon dioxide (CO2) in which the temperature in degrees Celsius is shown in the abscissa and the pressure in bar is shown in the ordinate.

This graph shows the four thermodynamic conditions in which CO2 may be situated depending on temperature/pressure: gaseous fluid (under ambient conditions), liquid fluid, solid or super-critical (at high pressure and temperature). In addition, the first triple point T1 should be noted, in which a thermodynamic gaseous phase FG, a solid FS, a liquid phase FL and a critical point T2 at which the gaseous thermodynamic phase FG, the liquid phase FL and the super-fluid phase FSF coexist. The triple point is at a temperature of approximately 210° C. and a pressure of approximately 8 bar and critical point T2 is at a temperature of approximately 90° C. and a pressure of approximately 300 bar.

It is clear that this diagram for CO2 is given here only as an example, since this unit can work advantageously with fluids which are more aggressive and dangerous than CO2, such as for example H2S, N2 and others.

It should be noted that in general, a "centrifugal compressor" is defined as a machine that works with a fluid in the gaseous state, and a "centrifugal pump" as a machine that works with a liquid fluid, whilst a fluid in the super-critical phase can be processed either by a compressor or a centrifugal pump. In particular, the definition "centrifugal pump for a super-critical fluid" can be defined as a machine that works with a super-critical fluid presenting a low density, whilst a "centrifugal compressor for a super-critical fluid" is a machine that works with a super-critical fluid with a high density In this description and in the attached claims a "second compression device" is also understood to refer to a machine that is able to compress a fluid in the liquid or super-critical phase (as indicated above), either at high or low density, and which for simplicity we can refer to by the generic term "centrifugal pump". The operation of unit 1 provides for taking in the process fluid—see arrow F1, that shows the direction of flow of the fluid—from the inlet aperture 6A, for it to undergo a first compression in the first stage C1 of the compressor C, so that the fluid leaves via the lateral aperture 6B to flow inside the cooler 13A and then be compressed in the second stage C2 via aperture 6C. From the second stage C2 the fluid flows into the outlet aperture 6D and then into the inlet aperture 6M through the motor M (cooling the motor M and the bearing 11F) and arrives at the third stage C3; after the fourth stage C4 it then leaves via the lateral aperture 6E in order to flow into the cooler 13B and then pass into the fifth stage C5 and subsequently to the sixth stage C6. From the sixth stage C6 the fluid leaves via the delivery aperture 6G in order to pass through the cooler 13, and then is fed into the pump P through the intake aperture 6H. Inside the pump P the fluid is processed as is described in reference to FIGS. 2 to 4, so that it leaves through the outlet aperture 6B.

FIG. 2 shows an enlarged section of the pump P from FIG. 1 in which in particular the shell 3C and the lateral shell 3F of the casing 3 should be noted, as well as the second rotor 7B supported by the first bearing 11A and the second bearing 11B (each composed of a magnetic bearing and an additional service bearing). This pump P is of the type with six stages P1 to P6 (each comprising a centrifugal impeller and a stator groove system 15) in a configuration in which the first three stages form a low pressure section and the following three stages form a high pressure section in order to raise the pressure P1 of the fluid F up to the outlet or delivery pressure Pf. It is clear that this pump P is only described for the purposes of explanation, and that it can be of any other type or configuration as, for example a reciprocating pump or other type.

In this diagram, there can also be observed the passage aperture 10 between the pump P and the compressor C, which is fitted inside, in the configuration described here, with coupling 9 and the first bearing 11A.

It is clear that such passage aperture 10 can be produced with different forms and dimensions depending on the particular application, see description above.

In one particularly advantageous embodiment, see also FIG. 2, provision is made for a first internal dynamic seal for the rotor 7A associated with the aperture 10 in the vicinity of the delivery side of the compressor C, able to prevent, at least partially, the fluid passing from the delivery side of the compressor C to the inside of the said aperture 10.

Such first seal 19 may be of the labyrinth type (also called "labyrinth seal", "honeycomb seal", "damper seal" or "dry gas seal") or another type. It should be noted that a controlled leakage may be provided for in seal 19; it is likewise possible to eliminate seal 19, see description below.

As indicated above, the location of the first bearing 11A in the passage aperture 10, although presenting the above advantages for longitudinal balancing and rotary dynamic balancing, also presents a difficulty regarding its cooling, since bearing 11A may be immersed at least partially in the process fluid at high temperatures, proceeding from the high pressure side of the compressor C due to leakage from the first seal 19, the temperature of this fluid being higher than the cooling temperature necessary for bearing 11A.

In a first embodiment, the cooling system, 21 comprises at least one first fluid dynamic circuit 22 produced using ducts 22A, 22B or 22C—still referring to FIG. 2—able to tap off, see arrow F2*a*, a part of the process fluid from the first stage P1, from an intermediate stage P2-P6 or respectively from the outlet aperture 6B of the pump P.

The pressure of the fluid tapped off is however higher and the temperature is lower in comparison with those of the output of the compressor C; in this manner the fluid can cool the bearing 11A and penetrate the aperture 10, from which it can leave via the first seal 19 in the form of leakage or loss from the said seal, reintroducing itself into the output of the compressor C. In a second embodiment, the cooling system 21 comprises at least one second fluid-dynamic circuit 23—see FIG. 3—produced with first ducts 23A able to tap off, see arrow F2*b*, part of the process fluid from intake 6G of the pump P, and mounted on support 15B of bearing 11A and/or through second ducts 23B mounted between the support 15B and the rotor 7B.

A first or second relief pipe 23D, 23E is advantageously provided in order to provide a fluid link, still referring to arrow F2*b*, between the bearing 11A and one of the stages C1 to C6 of the compressor C or respectively in order to provide a fluid link between the aperture 9 and one of the stages C1 to C6 of the compressor C, so as to direct the cooling fluid towards the compressor C.

In this case, the possible seal 19 permits a loss or leakage from the compressor C towards the pump P, the fluid from which can mix with the cooling fluid to be drawn from the compressor C through channels 23A or 23B.

In a third embodiment, the cooling system 21 comprises at least a third fluid dynamic circuit 24—see FIG. 4—able to cool bearing 11A thanks to part of the process fluid coming, see arrow F2*c*, from the output of compressor C via a calibrated tapping from the first seal 19 or, as an alternative, from a hole into the passage aperture 10, that is, eliminating seal 19.

In addition, provision is made for suitable pipes 24A on the support 15B for the bearing 11A and/or a space 24B produced around the rotor 7B in order to provide a fluid link, still referring to arrow F2*c*, between the bearing 11A and the first stage P1 of the pump P, in such a manner that the cooling fluid can mix with the process fluid upstream of the pump P.

In combination with this third fluid dynamic circuit 24 provision can also be made for cooling devices (not shown in the diagram for simplicity) between the compressor C and the pump P, or better in the passage aperture 10, so as to permit the cooling, at least of that part of the fluid used for cooling down to a temperature that is suitable for cooling bearing 11A more effectively.

For any one of the above-mentioned cooling circuits, it is also possible to provide for further pressurizing systems—not shown in the diagram for simplicity—in order to increase the pressure of the fluid in the said aperture 10 in an appropriate direction, as for example, a spiral surface keyed into the shaft 7B or a molded nozzle shape in the aperture 10 or other solutions.

However, it is understood that the above-mentioned fluid dynamic cooling circuits 22, 23 and 24 for the bearing 11A are not in any way exhaustive for the invention, since they simply represent examples of embodiments of the invention itself.

For example, it is possible to provide a pipe—not shown in the diagram for simplicity—to tap off part of the process fluid upstream of the pump P and downstream of the first cooling device 13, or another pipe able to tap the process fluid from one stage of the compressor C, introduce it into a cooler and then into bearing 11A, and thus send it back to the compressor C or some alternative arrangement.

In order to cool the fourth bearing 11D, the cooling system 21 may comprise a fourth fluid dynamic circuit—not shown in the diagram for simplicity—able to tap a part of the fluid from one of the stages P1-P6 of the pump P, send it to the said bearing 11D and then to one of the subsequent stages P2-P6 of the said pump P.

For cooling the other bearings 11B to 11F installed in the unit 1, the cooling system 21 may likewise provide for at least one additional fluid dynamic circuit—which also is not shown in the diagrams for simplicity—able to tap part of the fluid from one stage of the pump P and/or from the compressor C, in order to feed it into each bearing 11B-11F and then to reintroduce it into the nearest process flow.

It is clear that the cooling system 21, which is here described by way of example, is not in any way exhaustive for the invention.

Figure 5A:
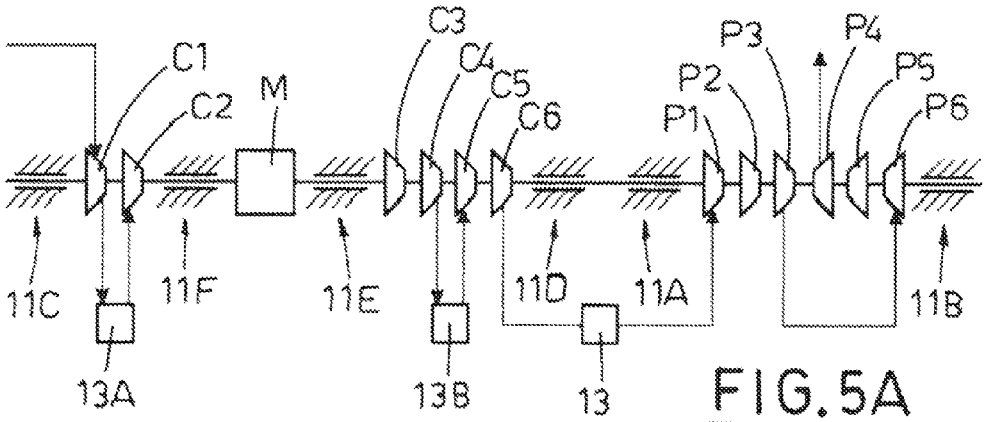
FIGS. 5A to 5C show in a schematic form different configurations for a compression unit in accordance with the invention.

FIG. 5A shows in a schematic manner, the configuration of the compressor unit 1 in the preceding diagrams, in which, in particular, the positioning of bearings 11A-11F should be noted.

This configuration is particularly compact, while at the same time facilitating the dynamic balancing of the rotor, since it guarantees optimal balancing of the different machines (compressor C, pump P and motor M).

Figure 5B:
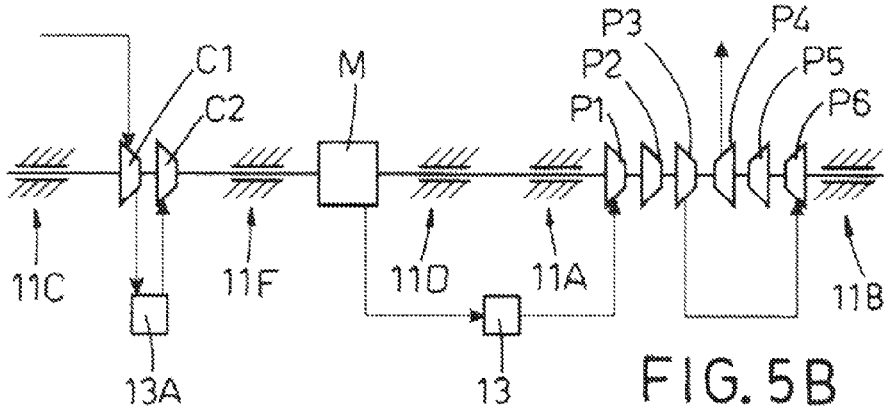

FIG. 5B shows another configuration of the machine similar to the preceding ones, but in which stages C3 to C6 of the compressor C have been eliminated.

In this case, the aperture 10, the bearings 11A, 11B, 11C, 11D and 11F and the cooling systems can be embodied in one of the configurations described below.

In this manner it is possible to obtain a compression unit that is even more compact and robust in its dynamics.

Figure 5C:
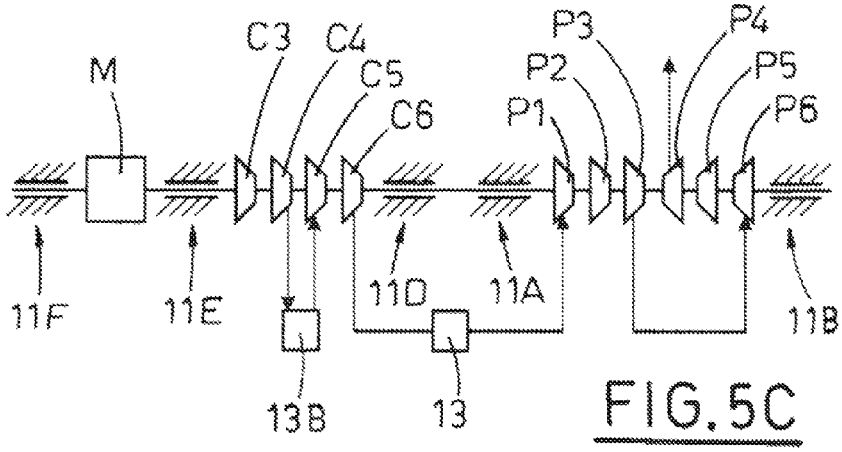

FIG. 5C shows a compression unit in accordance with another configuration of the invention similar to those above, but in which the first two stages C1, C2 of the compressor C have been eliminated, obtaining also in this case, a particularly compact and robust unit.

The aperture 10, the bearings 11A, 11B, 11D, 11E and 11F and the cooling systems can be produced with one of the configurations described above; in particular, the motor M and the bearing 11F can be cooled by making provision for suitable downstream taps.

It is clear that the above configurations are in no way exhaustive for the invention, since a large number of configurations can be envisaged on the basis of the operating conditions (pressure and temperature of the fluid, etc) and/or the rotation speed necessary for a particular application.

For example it is possible to eliminate at least one of the two bearings 11A or 11D or both of them, possibly replacing them with a rigid mechanical coupling, or with a single rigid rotor, or other solution.

It is also possible to eliminate at least one of the bearings 11E or 11F or both of them, for example, by reducing the number of stages of the compressor C or optimizing the design in other ways.

Moreover, it is possible to provide different configurations for the compressor C and/or for the pump P or for the cooling devices 13, 13A and 13B on the basis of the particular application.

In accordance with a further advantageous embodiment, the casing 3 may be produced (using a single shell or several shells) in such a manner as to permit the axial insertion and extraction of the compressor C, of the pump P and the motor M, in order to facilitate the fitting and maintenance of the said unit. It should be noted that in this last configuration, the passage aperture 10 provides adequate clearance to permit such insertion and extraction, with a molded wall that may be applied inside.

The reference to "an embodiment of the invention" or to a "form of embodiment of the invention" means that one particular characteristic structure or system described in it is included in at least one of the embodiments of the invention. Therefore, such references do not necessarily refer to the same embodiment, and can be combined in any manner within one or more compression units in accordance with the invention.

It is understood that any illustration represents only possible, non-restrictive embodiments of the invention, which may vary in its forms and arrangements without falling outside the scope of the concept that is the basis of the invention. The possible presence of reference numbers in the attached claims only has the purpose of making it easier to read them, with reference to the preceding description and to the attached drawings, and does not in any manner limit the scope of the protection.

What is claimed is:

1. A high pressure integrated compression unit for a process fluid, the compression unit comprising:

a first compression device configured to compress the process fluid from a substantially gaseous initial thermodynamic state to an intermediate thermodynamic state;

a pump connected mechanically to the first compression device and configured to compress said process fluid from said intermediate thermodynamic state to a liquid or supercritical state;

an external cooling device fluidly linked to said first compression device and to said pump for cooling the process fluid leaving said first compression device before entering said pump;

a motor device configured to drive said first compression device and said pump; and a pressure casing, wherein said pressure encloses at least said first compression devices and said pump, wherein said first compression devices and said pump are mechanically coupled to each other.

2. The compression unit according to claim 1, wherein said motor device is enclosed in said pressure casing.

3. The compression unit according to claim 1 wherein said motor device is directly coupled to said first compression device and said pump.

4. The compression unit according to claim 1, wherein said first compression device, said pump and said motor device are mechanically coupled to each other on a single drive axis.

5. The compression unit according to claim 1, wherein said pressure casing comprises mechanical seals only of the static type on its external side.

6. The compression unit according to claim 1, wherein the process fluid is substantially in a liquid or supercritical state in said intermediate thermodynamic state or in said final thermodynamic state.

7. The compressor unit according to claim 1, wherein the process fluid in said intermediate or final thermodynamic state, has a pressure greater than 80 bar, preferably greater than 100 bar.

8. The compression unit according to claim 1, wherein said pump is configured to work at the same rotation speed of said first compression device.

9. The compression unit according, to claim 1 wherein said first compression device and said pump are of the centrifugal type comprising respective centrifugal impellers associated with statoric channels, said centrifugal impellers being associated long said drive axis and being driven by at least one rotor coaxial with said drive axis.

10. The compression unit according to claim 1, comprising at least a passage opening for at least a rotor disposed long said drive axis between said pump and one of said devices of said machine.

11. The compression unit according to claim 10, wherein said opening passage is placed between said pump and the high pressure side of said first compression device.

12. The compression unit according to claim 10, wherein said opening passage includes comprises at least one of the following components:

at least one first internal dynamic seal working on said at least one rotor to provide a small calibrated loss or leakage that is useful for the working of said unit;

at least one mechanical coupling configured to couple mechanically two parts of said at least one rotor; and at least a one first mechanical bearing for said at least as rotor.

13. The compression unit according to claim 10, comprising at least one closed type cooling system configured to cool one or more mechanical bearings for said at least a rotor by means of said working fluid.

14. The compression unit according to claim 10, comprising at least one cooler for the working fluid in fluid connection between successive stages of said first compression device or said pump.

15. A method to compress a process fluid, the method comprising:

providing, a pressure casing closed by static external seals or gaskets toward the outside of the machine;

providing inside said pressure casing at least one first compression device configured to compress the process fluid from a substantially gaseous initial thermodynamic state to an intermediate thermodynamic state; at least one pump connected mechanically to said first compression device and configured to compress the process fluid from said intermediate thermodynamic state to a liquid or critical state; an external cooling device fluidly linked to said first compression device and to said pump for cooling the process fluid leaving said first compression device before entering in said pump;

and a motor device configured to drive said first compression devices and said pump; and activating said devices in order to compress the process fluid.

16. The method according to claim 15, wherein the activation phase comprises activating said first compression device to compress the working fluid to said intermediate thermodynamic state in a supercritical fluid condition and to activate said pump to further compress the working fluid from said intermediate thermodynamic state to said final thermodynamic state after cooling the working fluid at least once.

17. The method according to claim 15, wherein the activation phase comprises:

activating an external power supply circuit to fill said pump with working fluid; said working fluid being substantially at the same thermodynamic conditions of what will be fed by said first compression device; then to activate said first compression device and, at the same time, said pump; or activating said pump after said first compression device in order to allow that the working fluid fills at least in part said pump, before its activation; or activating said first compression device and said pump simultaneously.

* * * * *